US007592572B2

(12) United States Patent
Schlipf

(10) Patent No.: US 7,592,572 B2
(45) Date of Patent: Sep. 22, 2009

(54) COMPRESSED CARTRIDGE HEATER

(75) Inventor: Andreas Schlipf, Tuttlingen (DE)

(73) Assignee: Türk + Hillinger GmbH, Tuttlingen (DE)

( * ) Notice: Subject to any disclaimer, the term of this patent is extended or adjusted under 35 U.S.C. 154(b) by 336 days.

(21) Appl. No.: 11/459,705

(22) Filed: Jul. 25, 2006

(65) Prior Publication Data

US 2007/0023418 A1 Feb. 1, 2007

(30) Foreign Application Priority Data

Jul. 26, 2005 (DE) ..... 20 2005 011 686 U

(51) Int. Cl.
*H05B 3/06* (2006.01)
*H05B 3/78* (2006.01)

(52) U.S. Cl. ..... 219/532; 219/618; 219/628; 219/629; 219/630; 219/59.1; 219/67; 219/236; 219/243; 219/525; 219/523; 219/534; 219/535; 219/536; 219/537; 219/538; 219/539; 392/489; 392/503; 392/492; 174/102 R; 174/110 R; 174/118; 174/116; 174/102 P

(58) Field of Classification Search ..... 219/532, 219/618, 628–30, 59.1, 67, 236, 243, 525, 219/523, 534–9, 541–2, 544, 546; 392/489, 392/503, 492; 174/102 R, 110 R, 118, 116, 174/102 P See application file for complete search history.

(56) References Cited

U.S. PATENT DOCUMENTS

| | | | | |
|---|---|---|---|---|
| 2,224,422 | A | 12/1940 | Ballman | |
| 2,824,199 | A | 2/1958 | Browne | |
| 3,310,769 | A | 3/1967 | Simmons | |
| 3,313,921 | A | 4/1967 | Mohn et al. | |
| 5,095,193 | A * | 3/1992 | Doyle | 219/536 |
| 2004/0200829 | A1 * | 10/2004 | Hamburger et al. | 219/537 |

FOREIGN PATENT DOCUMENTS

| | | |
|---|---|---|
| CH | 96 306 | 10/1922 |
| DE | 18 74 589 | 6/1963 |
| DE | 1 515 216 | 12/1969 |
| DE | 21 44 520 B2 | 3/1973 |
| DE | 29 07 870 A1 | 9/1980 |
| DE | 19716010 | 10/1998 |
| DE | 7031974 | 6/2006 |
| FR | 1 400 035 | 6/1964 |
| GB | 1 074 532 | 7/1967 |

* cited by examiner

*Primary Examiner*—Shawntina Fuqua
(74) *Attorney, Agent, or Firm*—McGlew and Tuttle, P.C.

(57) ABSTRACT

A cartridge heater, especially a compressed cartridge heater (1) has at least one heating coil (8, 9), which is arranged exposed in a metallic tubular body (2) and is embedded in a granulated insulating material. The ends of heating coil portions (8, 9) are provided with terminals (7) projecting from the tubular body (2). To make it possible to manufacture such a cartridge heater with minimal effort in terms of labor and material, a flat insulating plate (10) coordinated in its width with the internal diameter of the tubular body (2) is provided as the carrier. The heating coils (8, 9) extend along the two flat sides of the insulating plate (10) and the two heating coils (8, 9) are connected to one another by a coil section (12, 12'), which is led around a deflecting edge (27) of the insulating plate (10).

21 Claims, 4 Drawing Sheets

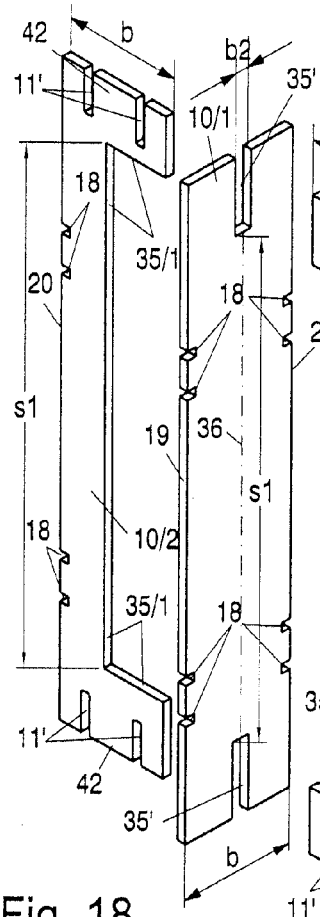
Fig. 16
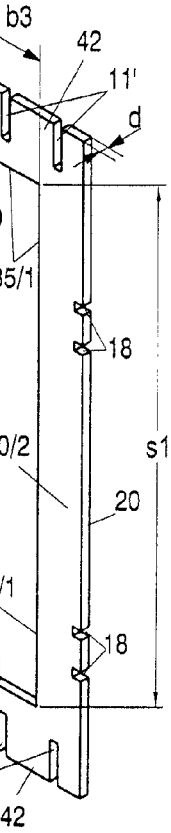
Fig. 17
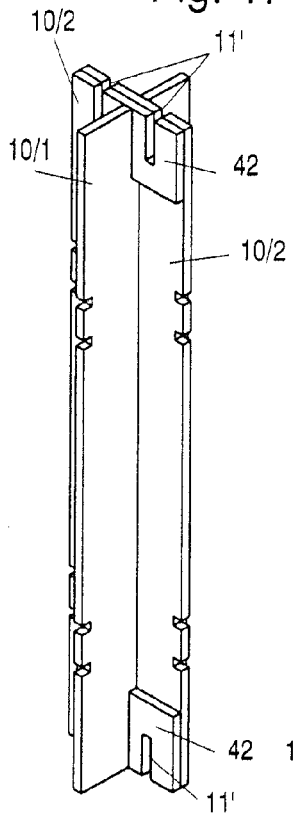
Fig. 20
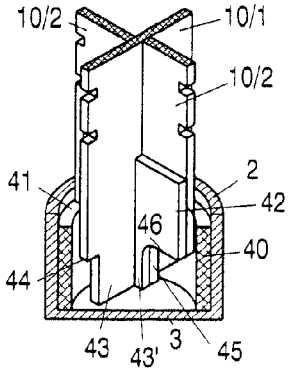
Fig. 20b
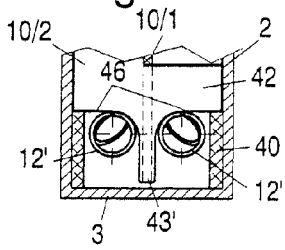
Fig. 18
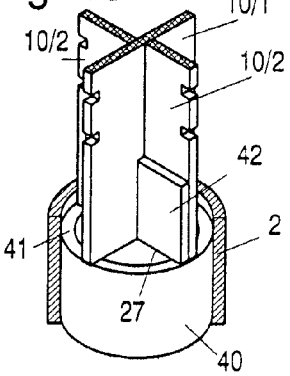
Fig. 19
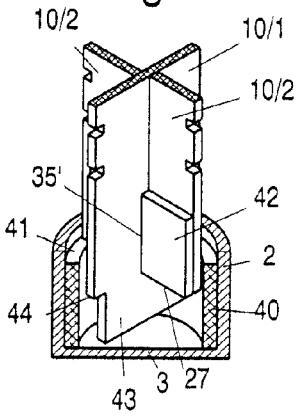
Fig. 20a
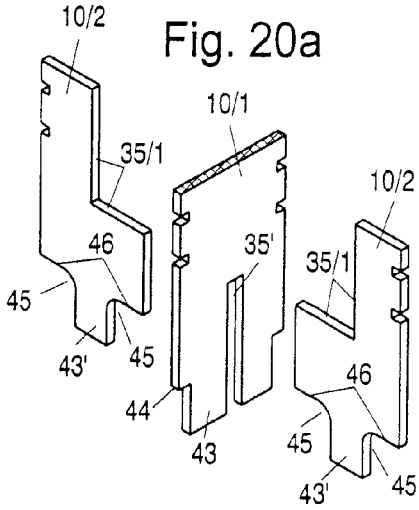
Fig. 18a
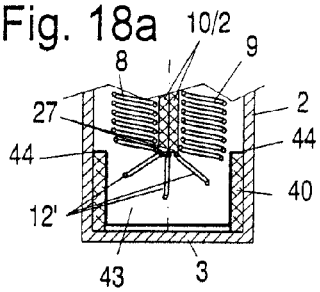

COMPRESSED CARTRIDGE HEATER

CROSS REFERENCE TO RELATED APPLICATIONS

This application claims the benefit of priority under 35 U.S.C. § 119 of German Patent Application DE 20 2005 011 686.6 filed Jul. 26, 2005, the entire contents of which are incorporated herein by reference.

FIELD OF THE INVENTION

The present invention pertains to a compressed cartridge heater with at least one heating coil, which is arranged exposed in a metallic tubular body and is embedded in a granulated insulating material and whose ends are provided with terminals projecting from the tubular body.

BACKGROUND OF THE INVENTION

A compressed cartridge heater of this type is known, for example, from DE 70 31 974 U. A plurality of heating conductor coils with different wire thicknesses and different coil diameters are accommodated in this cartridge heater concentrically with one another, exposed in a cylindrical cartridge housing, which has a fixed front-side bottom at one end and whose other end is closed by a metal disk with wart-like holes. Instead of the otherwise usual terminal screws, strands provided with insulating jackets are connected to the ends of the heating conductors. These strands are led through the metal disk toward the inside with their insulating jackets, so that there is an insulation between the metal disk and the conductor wires of the strands.

DE 197 16 010 C1 discloses an electric jacket tube heater with integrated temperature sensor, in which the heating conductor coils are installed in a hairpin-like pattern in the jacket tube and the connection of the heating conductor is led out at one end of the jacket tube and of the connection temperature sensor at the other end of the jacket tube. The heating coil is embedded in compressed insulating material.

No support elements, which ensure that when the insulating granular material is filled in, the windings of the heating coil will not come into contact with the tube wall, are provided whatsoever for the heating coils within the metal tube in these prior-art cartridge heaters. It must rather be ensured when the granular material is filled in that the heating coils will not be bent out and are kept away in space from the tube jacket.

This makes it difficult to fill in the granular material and causes high manufacturing costs.

SUMMARY OF THE INVENTION

The basic object of the present invention is to create a compressed cartridge heater of the type mentioned in the introduction, which can be manufactured with minimal effort in terms of labor and material.

This object is accomplished according to the present invention by providing as the carrier for the heating coils a flat insulating plate, which is coordinated in its width with the internal diameter of the tubular body, wherein the heating coils extend along the two flat sides of the insulating plate and are connected to one another by a coil section that is led around a deflecting edge of the insulating plate.

Due to the arrangement according to the present invention and the provision of flat insulating plates as the carrier for the heating coil, it is substantially simpler to place heating coils within the tube such that they cannot come into contact with the wall of the tube, so that less care is needed when filling in the insulating granular material, and this filling in can be carried out substantially more rapidly and thus at a lower cost. The connecting coil section may consist of a short wire section or comprise one or more windings.

It is simplest to use the lower, narrow-side end edge of the insulating plate as the deflecting edge.

Another simple possibility of insulating the coil section led around this lower end edge against the bottom of the tubular body and of keeping it away from it is the deflecting edge being formed by the narrow-side end edge of the insulating plate and the coil section led around same being separated from the bottom of the tubular body by an insulating disk or a spacer ring.

Other advantageous possibilities of keeping the deflecting edge or the coil section led around it away from the bottom of the tubular body are presented herein.

Holding clamps may be provided that are distributed over the length of the heating coils, consist of insulating material, surround the said heating coils and are fastened at the longitudinal edges of the said insulating plate.

The holding clamps may be provided with clamping fingers, which mesh with said locking notches of the insulating plate. The holding clamps may comprise U-shaped flat bodies and have U-shaped recesses in which the heating coils (8, 9) are guided. These measures guarantee simple and reliable fastening of the holding clamps on the insulating plate and, moreover, sufficient fixation in space of the heating coils within the tubular body.

To also have the possibility of arranging two heating coils on each flat side of the insulating plate, the heating coils may be connected to one another in pairs that can be associated with different heating circuits on the two flat sides of the insulating plate.

Another advantageous embodiment of the cartridge heater according to the present invention presents the special advantages that the heating coils extending in parallel next to one another are mutually insulated by the insulating plates located in between.

Several possibilities of embodiment are available for designing the insulating plates.

Holding clamps, which prevent the individual heating coil strands from bending out radially, may be provided in case of greater overall length.

The present invention will be explained in greater detail below on the basis of the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 16 is an isometric view of another embodiment of the intersecting insulating plates as individual parts;

FIG. 17 a perspective view showing the insulating plates from FIG. 16 in the assembled state;

FIG. 18 is a partially cut-away, isometric view of insulating plates that are assembled according to the principle of FIGS. 16 and 17, but which have no recesses at the lower edge;

FIG. 18*a* is a sectional view of the lower section of the cartridge heater in the embodiment according to FIG. 18;

FIG. 19 is partially cut-away, isometric view showing a variant of the embodiment according to FIG. 18;

FIG. 20 is partially cut-away, isometric view showing a variant of the embodiment according to FIG. 18;

FIG. 20*a* is a perspective view showing the insulating plates according to FIG. 20 as individual parts; and FIG. 20*b* of the lower section of the cartridge heater in the embodiment according to FIG. 20.

DESCRIPTION OF THE PREFERRED EMBODIMENTS

Figure 1:
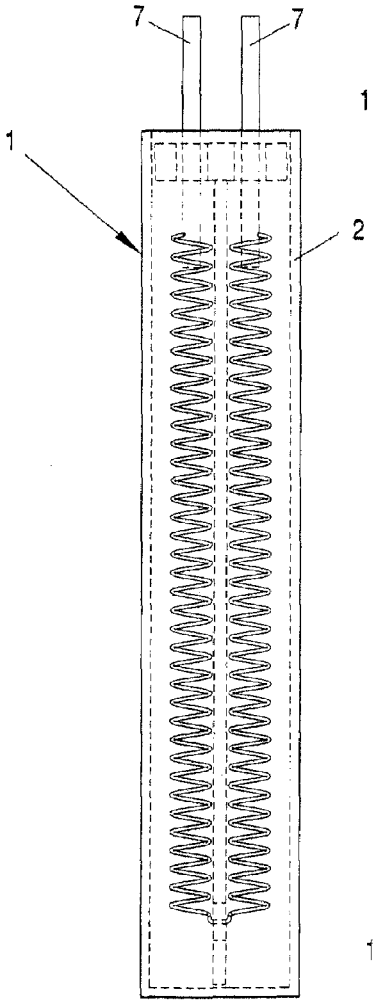
FIG. 1 is a side view of a compressed cartridge heater.

Referring to the drawings in particular, the cartridge heater 1 comprises a cylindrical tubular body 2, which has a fixed bottom 3 and whose upper, open end 4 is closed by a closing disk 5. The tubular body 2 consists of metal, preferably stainless steel. It may also consist of brass, copper or the like.

The closing disk 5 consists of an insulating material and is provided with passage openings 6 for terminal screws 7 of two heating coils 8 and 9. The two heating coils 8 and 9 extend on both sides of an insulating plate 10, which is arranged centrally in the tubular body 2 and acts as a carrier for the heating coils 8 and 9.

Figure 3:
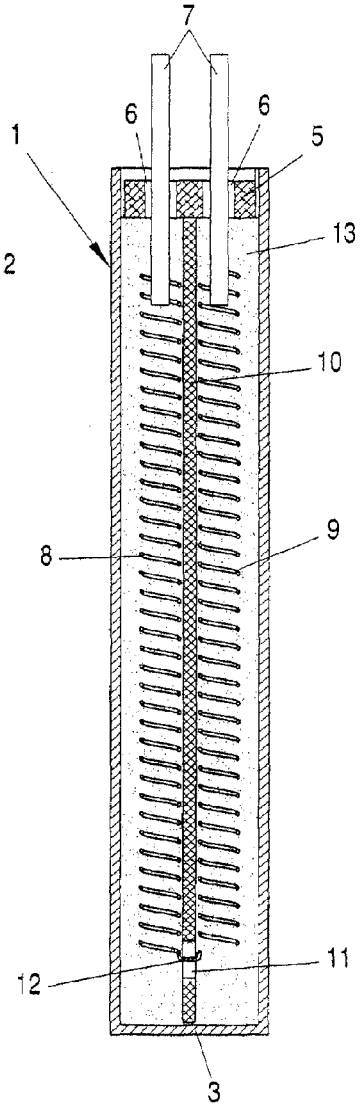
FIG. 3 is a section III from FIG. 2.
Figure 2:
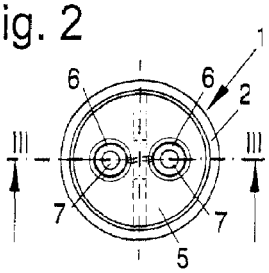
FIG. 2 is a top view II from FIG. 1.
Figure 4:
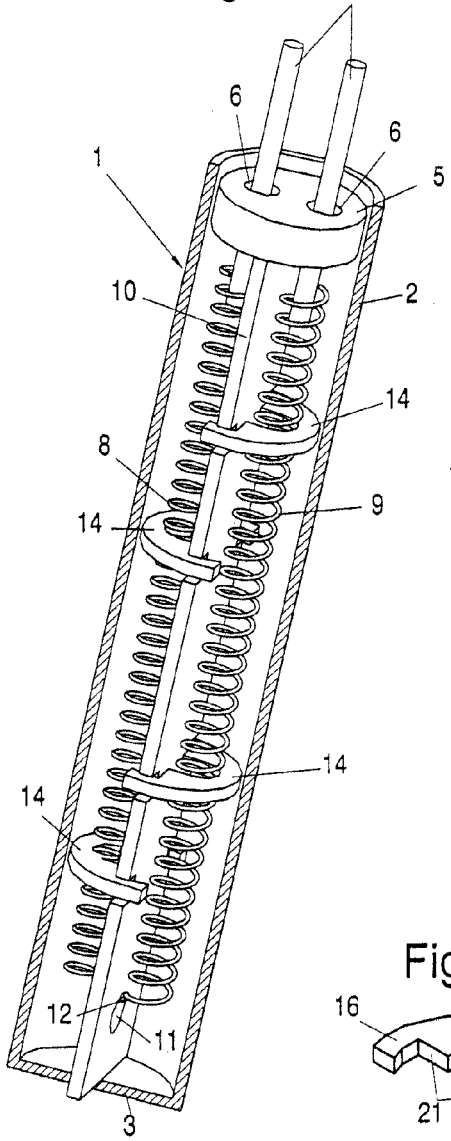
FIG. 4 is a 3-D view of the cartridge heater with a cut-away sectioned tubular body.
Figure 5:
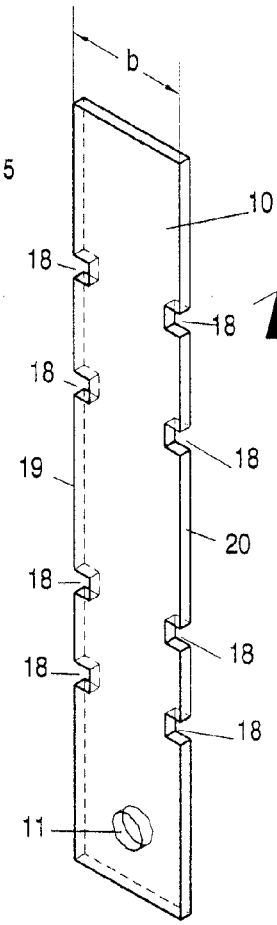
FIG. 5 is a perspective showing an insulating plate as an individual part.

In the embodiment according to FIGS. 1 through 3 as well as FIGS. 4 and 5, the insulating plate 10 is provided, in the area of its lower end, with a recess 11 shaped as a hole, through which a coil section 12 connecting the two heating coils 8 and 9 to one another is led. As is shown in FIGS. 7 through 13, the recess may also be designed as an open slot 11'. The deflecting edge, with which the coil section 12 is in contact, is located in the recess 11 or 11' in these embodiments.

These recesses 11 and 11' expediently have a size coordinated with the diameter of the heating coils 8 and 9, so that one of the two heating coils 8, 9 can be easily lead through this recess 11 or 11'.

Figure 3A:
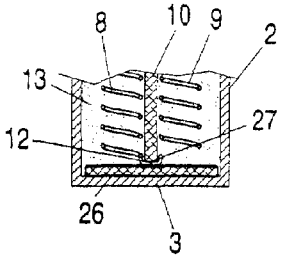
FIG. 3*a* is a sectional view of the lower section of the cartridge heater with another insulating plate.

As is shown in FIG. 3*a*, it is also possible to use the lower end edge 27 of the insulating plate 10 as a deflecting edge and to lead the connecting coil section 12 directly around this end edge 27. However, it is necessary for this to insulate the coil section 12 by an inserted insulating disk 26 against the bottom 3. To achieve a certain fixation of the position for the coil section 12 in this case as well, the lower end edge of the insulating plate 10 may be provided with a notch, not shown. The notch is used as a deflecting edge for the coil section 12 in this embodiment.

As is shown by the example according to FIGS. 18 through 20*b*, it is also possible to establish an insulating distance from the bottom 3 by inserting a spacer ring 40 made of an insulating material, e.g., ceramic, on which the lower edge of the insulating plate 10 is seated.

The cavity of the tubular body 2 between the bottom 3 and the closing disk 5 is filled with an insulating material (granulated insulating material) 13, which may consist of quartz sand or a metal oxide, especially magnesium oxide. A granular product consisting of heat-resistant plastic may also be used for this purpose.

It shall be pointed out here that the drawings show the cartridge heater 1 in the noncompressed state.

In case of relatively small overall lengths of the tubular body 2, the two heating coils 8 and 9 are sufficiently guided within the tubular body 2 by the insulating plate 10 and the two terminal screws 7, which are rigidly connected to the upper ends of the heating coils 8 and 9, and are protected against bending out radially and thus against touching the wall of the tubular body.

If the cartridge heater has a greater overall length, it is useful to secure the heating coils 8 and 9 by holding clamps 14 arranged distributed over the length. These holding clamps 14 consist of U-shaped flat bodies made of insulating material and are provided with U-shaped recesses 15, in which the heating coils 8 and 9 are guided.

In addition, these holding clamps have clamping fingers 16 and 17, which engage locking notches 18 of the insulating plate 10 in a locking and positive-locking manner. These locking notches 18 are arranged in pairs opposite each other on the longitudinal edges 19 and 20 of the insulating plate 10. With support surfaces 21 arranged on both sides of the U-shaped recess 15, the holding clamps 14 are in contact with the respective flat sides of the insulating plate 10. The insulating plate 10 may consist of micanite or ceramic or plastic.

Figure 7A:
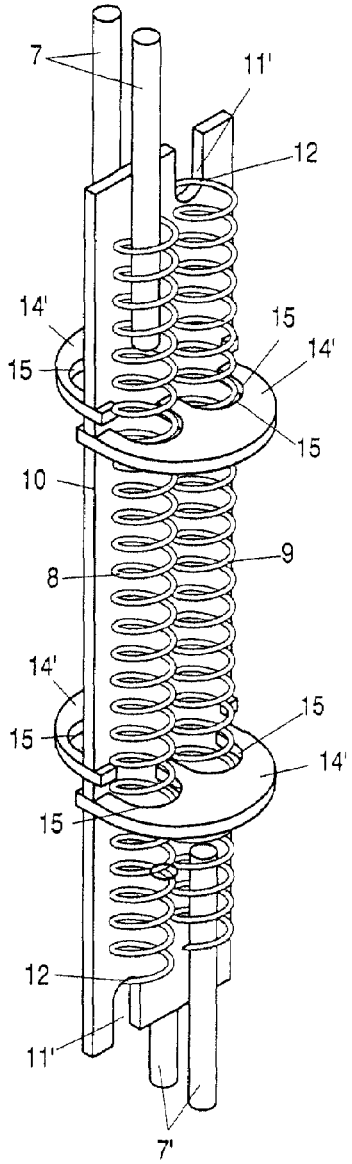
FIG. 7*a* an isometric view showing a variant of FIG. 7.
Figure 7:
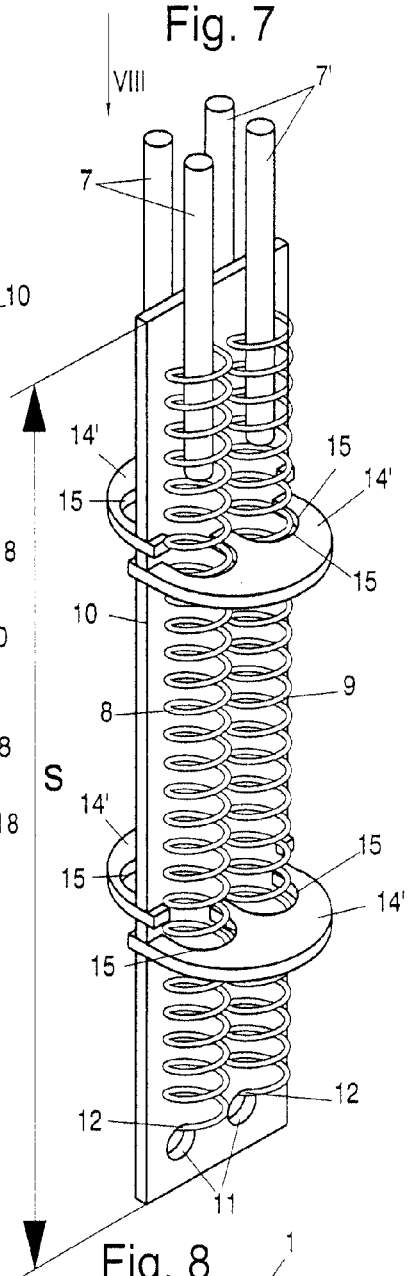
FIG. 7 is an isometric view of a carrier plate with two heating coil pairs.
Figure 6:
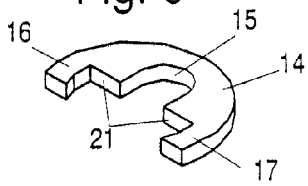
FIG. 6 is a holding clamp as an individual part.
Figure 8:
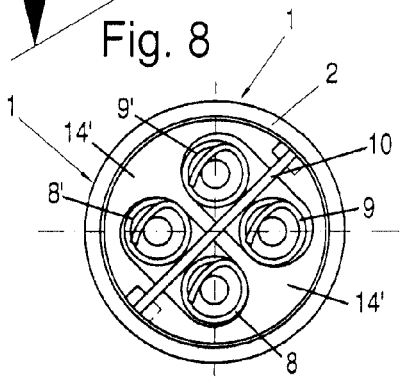
FIG. 8 is a front view VIII from FIG. 7 with the tubular body from FIG. 4.

Two heating coils 8 and 8' and 9 and 9' each are arranged on both sides of the insulating plate 10 in such a way that they extend in parallel to one another in the embodiment according to FIGS. 7 and 8. Their top ends are connected to the respective terminal screws 7 and 7'. The two heating coils 8 and 8' are visible in FIG. 8 only.

The insulating plate 10 is provided with two slot-like recesses 11' at its lower end in this embodiment. These recesses could also be designed as holes.

To also support the two heating coils 8 and 8' on one side and 9 and 9' on the other side of the insulating plate 10 against bending out at the same time, holding clamps 14', which are arranged distributed over the length, are equipped with two U-shaped recesses 15' each, and by which a heating coil 8, 8' and 9, 9' each is guided, are provided.

These holding clamps 14' are also provided with lateral clamping fingers 16 and 17, which engage notches 18 of the insulating plate 10 in a positive-locking manner. Between the U-shaped recesses 15 and 15', there is a support finger 22, whose front surface 21 with the other two support surfaces 21 at the clamping fingers 17 and 18 is supportingly in contact with the flat side of the insulating plate 10.

Figure 14:
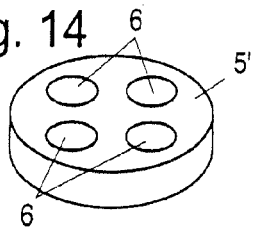
FIG. 14 is a perspective view showing the closing disk from FIG. 10 as an individual part.

In the embodiment according to FIGS. 7 and 8, a closing disk 5' (FIG. 14) with four passage openings 6 is provided, through which the four terminal screws 7 and 7' are led to the outside.

Figure 14A:
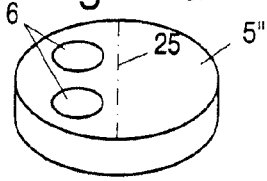
FIG. 14*a* is a perspective view showing a variant of the closing disk of FIG. 14.

The embodiment according to FIG. 7*a* provides for the terminal screws 7' of the two heating coils 9 and 9' (FIG. 8) to be arranged at the lower end of the insulating plate 10 and thus to project from the tubular body 2 on the lower front side. Accordingly, the tubular body 2 is not equipped with a lower front wall 3 but, instead, likewise with a closing disk 5" according to FIG. 14*a*, which is also used to close the upper end of the tubular body in this case. The passage openings 6 of this closing disk 5" are arranged, corresponding to the terminal screws 7 and 7', eccentrically, offset to one side in relation to the central plane 25.

In the embodiment according to FIGS. 10 through 15, the cavity of the tubular body 2 is divided by two insulating plates 10', which intersect centrally, into four space sectors 31, 32, 33 and 34 (FIG. 11), in which a heating coil 8, 8', 9, 9' each is located. At least one of the insulating plates 10' must be provided with two recesses 11, through which a coil section 12 each extends, which connects two heating coils 8 and 8' as well as 9 and 9' extending on the two flat sides of the insulating plate 10' to one another.

Figure 12:
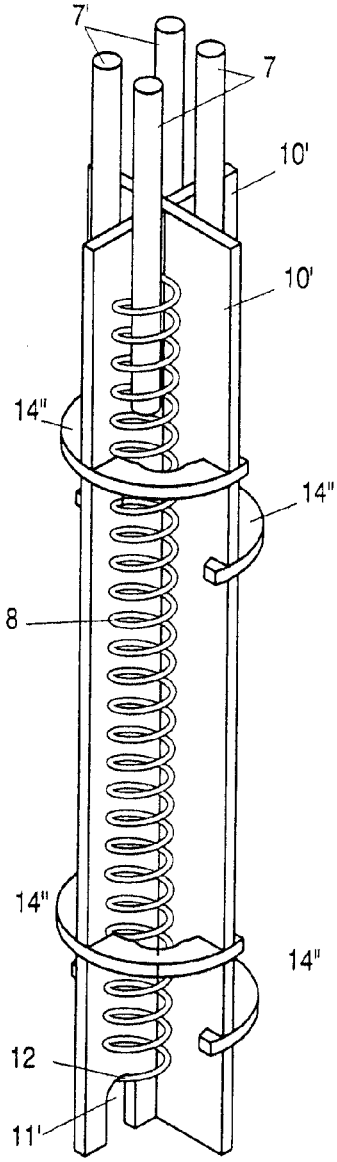
FIG. 12 is an isometric view of the carrier plates and heating coils arranged in the tubular body according to FIGS. 10 and 11.
Figure 10:
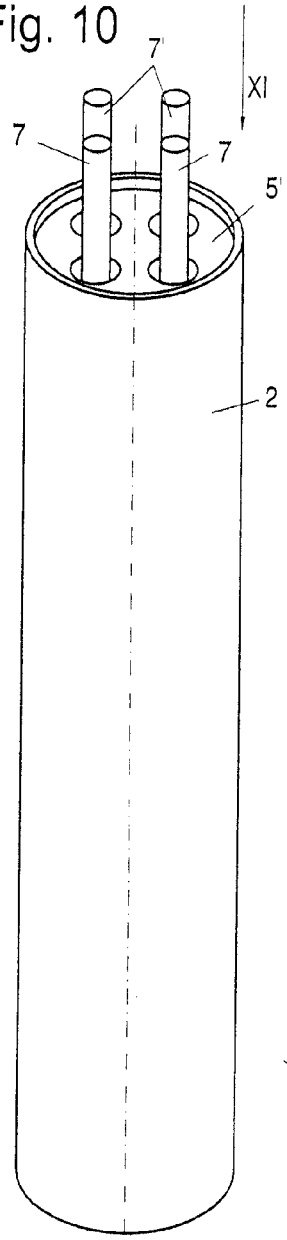
FIG. 10 is an isometric side view of another cartridge heater.
Figure 13:
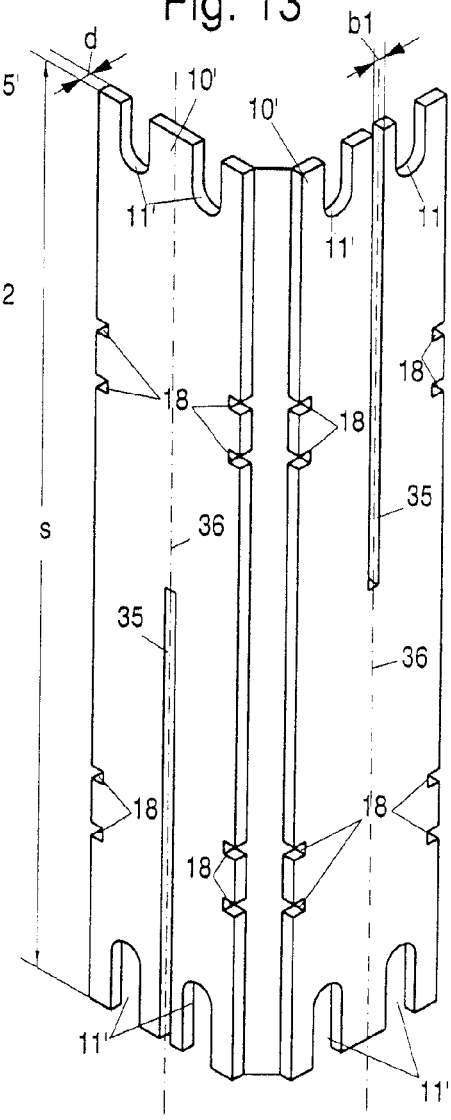
FIG. 13 is a perspective view showing the two insulating plates according to FIG. 12 as individual parts.
Figure 11:
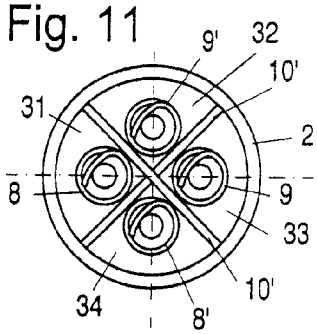
FIG. 11 is a front view XI from FIG. 10.

In the exemplary embodiment according to FIG. 13, both insulating plates 10' are provided with two slot-like recesses 11' each at both the top end and the lower end, so that these two can be pushed into the tubular body 2 in any desired position in a centrally crossing position, as is shown in FIGS. 11 and 12. Strictly speaking, this is only an insulating plate 10' that is present in a pair, one of which is upside down. To make it possible to connect the two insulating plates 10' to one another in a crossing position in a positive-locking manner, the two insulating plates 10' are provided with insertion slots 35 each, which extend centrally and symmetrically to their longitudinal axis 35. These insertion slots 35 have a width b1 each, which corresponds to the thickness d of an insulating plate 10'. To make it possible to insert flush the two insulating plates 10', which are of equal length and equal width and are also shaped identically otherwise, it is necessary for these insertion slots 35 to extend at least over half the length s.

Figure 5A:
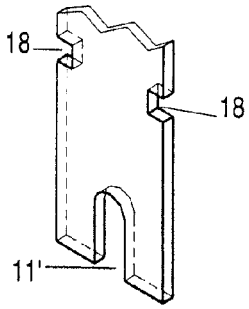
FIG. 5*a* is another embodiment of the insulating plate from FIG. 5.
Figure 9:
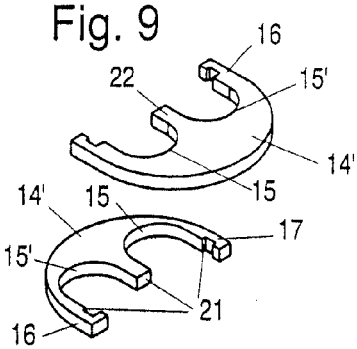
FIG. 9 is a perspective view showing the holding clamps from FIG. 7 as individual parts.

These insulating plates 10' are also provided with open slots 11' (FIG. 5*a*) instead of with holes 11.

To support the heating coils 8, 8', 9 and 9', holding clamps 14" made of insulating material, which have a U-shaped flat shape, are provided with two clamping fingers 16 and 17 and also have support surfaces 21. The recesses 15 and 15', which are designed without support fingers 22 in this case, are located between the support surfaces. A notch-like recess 15/1, whose connection web 15/2 is accommodated by a notch 18 of the respective bridged-over insulating plate 10' is provided between these recesses 15 and 15'.

The holding clamps 14" are otherwise used in the same manner as the holding clamps 14'.

Other embodiments of insulating plates arranged crosswise are shown in FIGS. 16 through 20*b*. A first insulating plate 10/1 of the usual shape and with the locking notches 18 arranged at the longitudinal edges 19 and 20 is provided for fastening holding clamps 14" according to FIGS. 12 and 15.

This insulating plate 10/1 has insertion slots 35' each, extending symmetrically to its longitudinal axis 36, in the area of its narrow-side end sections. These two insertion slots 35' have a width b2, which corresponds to twice the thickness d second insulating plate 10/2. In addition, these insertion slots 35' have a longitudinal distance s1. This longitudinal distance s1 corresponds to the length s1 of a rectangular opening 35/1, which the two second insulating plates 10/2, which otherwise have an identical shape, have. The two remaining end sections 42 of these two second insulating plates 10/2 have the width b.

The width b3 of the openings 35/1 corresponds to b/2+d/2. As a result, as is shown in FIG. 17, the end sections 42 can be introduced congruently into the insertion slots 35' of the insulating plate 10/1 such that they project from these by equal amounts on both sides.

Figure 15:
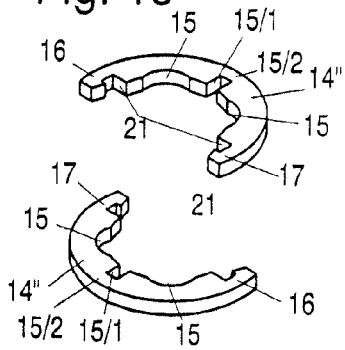
FIG. 15 is a perspective view showing the holding clamps from FIG. 12 as individual parts.

The upper and lower end sections 42 of the two second insulating plates 10/2 touch each other on their flat sides, as is shown in FIG. 17. The outer edges 20 of the second insulating plates 10/2 are likewise provided with locking notches 18, which are used to receive holding clamps 14' (FIG. 15).

The upper and lower end sections 42 of the second insulating plates 10/2 are provided each with recesses 11', which are arranged symmetrically to the first insulating plate 10/1 and are mutually flush with one another and through which coil sections 12 or windings 12' of the heating coils 8, 9 can be led.

To make it possible to do away with such recesses 11' and to use the lower, closed end edges 27 as deflecting edges for the coil section 12 or windings 12', a spacer ring 40 each, which is seated on the bottom 3 and at the top edge 41 of which the insulating plates 10/1 and 10/2 are seated, is provided in the embodiments according to FIGS. 18 through 20*b*. As a result, the coil section 12 or the windings 12' receive the proper distance from the bottom 3 of the tubular body 2.

In the embodiment according to FIGS. 19 and 20, the first insulating plate 10/1 is provided with an extension 43 protruding into the spacer ring 40. The insertion slot 35' is not led up to the lower end of this extension 43 in this embodiment, but it rather ends at the level of a support shoulder 44, with which the first insulating plate 10/1 is seated on the upper edge 41 of the spacer ring 40.

This extension 43 is also present in the embodiment according to FIG. 18*a*. The two heating coils 8 and 9, which are connected to one another in one piece, are led around the lower edges 27 of the two second insulating plates 10/2 with a plurality of windings 12', which are shown in exemplary embodiment 3. The extension 43 of the first insulating plate 10/1 protects the windings 12' of the heating coils 8 and 9 extending on the two sides of the insulating plate 10/1, which said windings 12' are led around the lower edges 27 of the second insulating plates 10/2, against mutually touching one another.

In FIGS. 20, 20*a* and 20*b*, the two second insulating plates 10/2 are provided with an extension 43' each, which is arranged between two recesses 45, which are open on the side and at the end.

The deflecting edges are formed by the horizontal sections 46 of the recesses 45 in this embodiment. As can be recognized from FIG. 20, a plurality of windings 12' of the heating coils 8 and 9 can be led around these deflecting edges 46 and maintain the necessary distance from the bottom 3 in the case of the recesses 45 that are open both on the end and laterally.

The cartridge heater is assembled in all embodiments shown such that the heating coils 8, 8', 9, 9' are first mounted with the respective terminal screws 7 and 7' fastened thereto on the insulating plates 10 and 10' in the manner shown in the drawing and are secured by the holding clamps 14 and 14' or 14". This premounted component is then inserted into the tubular body 2 and the remaining cavity is filled with the granulated insulating material from the open upper side. The closing disk 5 and 5' is then inserted into the upper end of the tubular body 2 and the tubular body is pressed radially from the outside such that not only does the granulated insulating material undergo intense compaction, but the passage openings 6 of the closing disk 5 and 5' are also reduced in size such that they are tightly in contact with the terminal screws 7 and 7'.

Instead of the usual terminal screws 7, 7', it is also possible to provide other terminals, as is known from DE 70 31 974 U, e.g., jacketed strands.

The closing disks 5, 5' and 5" consisting of insulating solids may also be replaced with other closing means. Depending on the nature of the insulating material filled into the tubular body, they may even be able to be omitted.

It is easy to imagine that the heating coils 8, 8', 9, 9' fastened to the insulating plate or plates 10 and 10' do not run the risk of coming into contact with the wall of the tubular body 2, especially because they are also secured by the holding clamps 14 and 14' and 14" against bending out radially. Since this granulated insulating material is a very fine-grained material, which has a high flowability, the filling into the tubular body can be carried out in a relatively problem-free manner such that no cavities, which can be reliably prevented from occurring by simple vibration, are left.

On the whole, the assembly of the heating coils 8 through 9' and the filling in of the granulated insulating material are substantially simplified and thus also made less expensive by the use of the insulating plates 10 and 10'.

While specific embodiments of the invention have been shown and described in detail to illustrate the application of the principles of the invention, it will be understood that the invention may be embodied otherwise without departing from such principles.

What is claimed is:

1. A cartridge heater comprising:

a metallic tubular body;

granulated insulating material;

terminals;

one or more heating coils defining coil portions arranged exposed in said metallic tubular body and embedded in said granulated insulating material, said heating coil having ends provided with terminals with each of said terminals led out of said tubular body;

a flat insulating plate having a width coordinated with an internal diameter of said tubular body and defining a carrier for said heating coil, said heating coil portions each respectively extending along one of two flat sides of said insulating plate and being connected to one another by a coil section led around a deflecting edge of said insulating plate.

2. A cartridge heater in accordance with claim 1, wherein said deflecting edge is formed by a narrow-side end edge of said insulating plate.

3. A cartridge heater in accordance with claim 2, further comprising an insulating disk or a spacer ring wherein said deflecting edge is formed by a narrow-side end edge of said insulating plate and a coil section is led around same and is separated from a bottom of said tubular body by said insulating disk or said spacer ring.

4. A cartridge heater in accordance with claim 1, wherein said deflecting edge is located in a recess of said insulating plate.

5. A cartridge heater in accordance with claim 1, wherein said insulating plate is provided with two recesses, each through which a coil section extends, which connects two said heating coil portions extending on the two said flat sides of the insulating plate.

6. A cartridge heater in accordance with claim 5, wherein said insulating plate is provided with recesses through which one or more said coil sections are led.

7. A cartridge heater in accordance with claim 1, further comprising holding clamps distributed over a length of said heating coil portions, said holding clamps comprising insulating material surrounding one or more heating coil portions, said holding clamps being fastened at longitudinal edges of said insulating plate.

8. A cartridge heater in accordance with claim 7, wherein said holding clamps each have clamping fingers each meshing with a respective one of locking notches defined by said insulating plate.

9. A cartridge heater in accordance with claim 4, further comprising holding clamps comprising U-shaped flat bodies having U-shaped recesses, in which the heating coil portions are guided.

10. A cartridge heater in accordance with claim 7, wherein said holding clamps have two U-shaped recesses each, through which a heating coil each is led.

11. A cartridge heater in accordance with claim 1, further comprising another insulating plate wherein said insulating plate and said another insulating plate form centrally crossing insulating plates wherein said tubular body defines a cylindrical cavity divided by said centrally crossing insulating plates providing space sectors each receiving one of said heating coil portions, wherein at least one of said insulating plates is provided with at least said deflecting edge located away from a bottom of said tubular body.

12. A cartridge heater in accordance with claim 11, wherein at least one of the crossing insulating plates is provided with at least one recess through which a coil section each extends, which connects two said heating coil portions extending on the two flat sides of the insulating plate.

13. A cartridge heater in accordance with claim 11, further comprising an insulating spacer ring wherein said deflecting edge formed by the narrow-side end edge of one of said insulating plates is held at a spaced location from said bottom of said tubular body by said insulating spacer ring.

14. A cartridge heater in accordance with claim 11, wherein at least one of the crossing insulating plates is provided with at least one recess through which one or more windings of the said heating coil portions extending on the two flat sides of the insulating plate are led.

15. A cartridge heater in accordance with claim 11, wherein said central crossing insulating plates are connected to one another by insertion slots extending centrally and each symmetrically to a respective longitudinal axis and at least over half of a length of said central crossing insulating plates.

16. A cartridge heater in accordance with claim 10, further comprising two second insulating plates wherein said insulating plate has said insertion slots extending symmetrically to a longitudinal axis in an area of a narrow-side end section of said insulating plate, said two second insulating plates being of equal width arranged on opposite flat sides of said insulating plate and extend at right angles to said flat sides, each of said two second insulating plates having openings receiving the sections of said insulating plate that are located between said insertion slots.

17. A cartridge heater in accordance with claim 11, wherein said heating coil portions are arranged in space sectors and are secured against bending out radially by said holding clamps.

18. A cartridge heater in accordance with claim 11, wherein said terminals each extend on one of two flat sides of said insulating plate and exit on opposite front sides of said tubular body.

19. A cartridge heater in accordance with claim 1, wherein said insulating plates consists essentially of one or more of micanite, ceramic or plastic.

20. A cartridge heater in accordance with claim 1, wherein:

said granulated insulating material, said one or more heating coils, and said flat insulating plate are compressed in said metallic tubular body to form a compressed cartridge heater.

21. A cartridge heater comprising:

a metallic tubular body;

granulated insulating material;

terminals;

one or more heating coils defining coil portions arranged exposed in said metallic tubular body and embedded in said granulated insulating material, said heating coil having ends provided with terminals with each of said terminals led out of said tubular body;

a flat insulating plate having a width coordinated with an internal diameter of said tubular body and defining a carrier for said heating coil, said heating coil portions each respectively extending along one of two flat sides of said insulating plate and being connected to one another by a coil section led around a deflecting edge of said insulating plate;

holding clamps surrounding one or more of said heating coil portions, said holding clamps having two U-shaped recesses each, through which said one or more heating coils each is led.

* * * * *